US009108836B2

(12) United States Patent
Clusserath

(10) Patent No.: US 9,108,836 B2
(45) Date of Patent: Aug. 18, 2015

(54) METHOD AND FILLING ELEMENT FOR THE PRESSURE-FILLING OF CONTAINERS WITH A LIQUID FILLING MATERIAL

(75) Inventor: Ludwig Clusserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 270 days.

(21) Appl. No.: 13/697,843

(22) PCT Filed: Apr. 8, 2011

(86) PCT No.: PCT/EP2011/001755

§ 371 (c)(1),
(2), (4) Date: Nov. 14, 2012

(87) PCT Pub. No.: WO2011/160740

PCT Pub. Date: Dec. 29, 2011

(65) Prior Publication Data

US 2013/0061980 A1 Mar. 14, 2013

(30) Foreign Application Priority Data

Jun. 21, 2010 (DE) ..... 10 2010 024 522

(51) Int. Cl.

| | |
|---|---|
| ***B65B 3/04*** | (2006.01) |
| ***B67C 3/26*** | (2006.01) |
| *B65B 3/26* | (2006.01) |

(52) U.S. Cl.

CPC ..... *B67C 3/2622* (2013.01); *B65B 3/04* (2013.01); *B65B 3/26* (2013.01); *B67C 2003/2685* (2013.01)

(58) Field of Classification Search

USPC ..... 141/4–6, 44–45, 63, 94–96, 198, 392

See application file for complete search history.

(56) References Cited

U.S. PATENT DOCUMENTS

| | | | | | |
|---|---|---|---|---|---|
| 3,500,880 | A | * | 3/1970 | Meyer, Sr. | 141/40 |
| 3,604,480 | A | | 9/1971 | Reichert et al. | |
| 4,386,635 | A | * | 6/1983 | Ahlers et al. | 141/6 |
| 4,982,768 | A | * | 1/1991 | Ahlers | 141/6 |
| 5,190,084 | A | * | 3/1993 | Diehl et al. | 141/39 |
| 5,402,833 | A | * | 4/1995 | Clusserath | 141/39 |
| 5,445,194 | A | * | 8/1995 | Clusserath | 141/39 |
| 5,501,253 | A | * | 3/1996 | Weiss | 141/40 |
| 5,564,481 | A | * | 10/1996 | Clusserath | 141/92 |
| 5,634,500 | A | * | 6/1997 | Clusserath et al. | 141/48 |

(Continued)

FOREIGN PATENT DOCUMENTS

| | | |
|---|---|---|
| DE | 1 607 996 | 7/1967 |
| DE | 38 42 579 | 6/1990 |

(Continued)

*Primary Examiner* — Nicolas A Arnett

(74) *Attorney, Agent, or Firm* — Occhiuti & Rohlicek LLP

(57) ABSTRACT

A method for filling containers with a filling material under pressure using a filling system comprising a filling element, which has a liquid channel having a liquid valve in a filling element housing, wherein the liquid channel is connected to a liquid chamber of a filling material vessel, which is partially filled with filling material and under pre-stress or filling pressure, upstream of the liquid valve in the flow direction of the filling material and forms at least one discharge opening downstream of the liquid valve in the flow direction of the filling material, at which discharge opening the particular container is arranged with a container opening in a sealed position at least during the filling process, and wherein a probe is arranged in a return gas pipe.

12 Claims, 3 Drawing Sheets

(56) References Cited

U.S. PATENT DOCUMENTS

| | | | | |
|---|---|---|---|---|
| 6,189,578 | B1 * | 2/2001 | Clusserath | 141/7 |
| 6,470,922 | B2 * | 10/2002 | Sindermann | 141/37 |
| 7,104,033 | B2 * | 9/2006 | Krulitsch | 53/467 |
| 7,469,726 | B2 * | 12/2008 | Clusserath et al. | 141/57 |
| 7,958,917 | B2 * | 6/2011 | Conforti | 141/95 |
| 8,251,107 | B2 * | 8/2012 | Clusserath et al. | 141/59 |
| 8,726,946 | B2 * | 5/2014 | Clusserath et al. | 141/6 |
| 8,776,839 | B2 * | 7/2014 | Clusserath et al. | 141/48 |
| 2001/0045242 | A1 * | 11/2001 | Clusserath et al. | 141/144 |
| 2002/0014276 | A1 * | 2/2002 | Clusserath | 141/40 |
| 2005/0172580 | A1 * | 8/2005 | Krulitsch | 53/471 |
| 2005/0241726 | A1 * | 11/2005 | Clusserath et al. | 141/144 |
| 2006/0137762 | A1 | 6/2006 | Ruble et al. | |
| 2009/0293985 | A1 * | 12/2009 | Till et al. | 141/1 |
| 2010/0071802 | A1 * | 3/2010 | Clusserath et al. | 141/44 |
| 2010/0071803 | A1 * | 3/2010 | Clusserath et al. | 141/65 |
| 2010/0212773 | A1 * | 8/2010 | Clusserath et al. | 141/6 |
| 2012/0174529 | A1 * | 7/2012 | Clusserath | 53/127 |
| 2013/0037168 | A1 * | 2/2013 | Clusserath et al. | 141/63 |
| 2013/0180619 | A1 * | 7/2013 | Clusserath et al. | 141/6 |

FOREIGN PATENT DOCUMENTS

| | | |
|---|---|---|
| DE | 44 44 346 | 6/1996 |
| EP | 0 554 690 | 8/1993 |

* cited by examiner

METHOD AND FILLING ELEMENT FOR THE PRESSURE-FILLING OF CONTAINERS WITH A LIQUID FILLING MATERIAL

CROSS REFERENCE TO RELATED APPLICATION

This application is the national phase under 35 USC 371 of international application no. PCT/EP2011/001755, filed Apr. 8, 2011, which claims the benefit of the priority date of German application no. 10 2010 024 522.4, filed Jun. 21, 2010. The contents of the aforementioned applications are incorporated herein in their entirety.

FIELD OF DISCLOSURE

The invention relates to a method and to a filling element for filling bottles or similar containers with a liquid filling material.

BACKGROUND

For pressure-filling containers, it is known to use a single-chamber filling system. In such a system, the filling process includes a filling phase. The filling phase involves opening a liquid valve so that liquid filling material flows into a container that is arranged in sealed position against the filling element. This container will have been pre-tensioned with an inert gas that is maintained at filling pressure. As the container fills, the liquid filling material displaces the inert gas. This displaced gas returns, through a return gas tube that extends into the container during filling, to a gas space of a partially filled tank or into a channel carrying the inert gas. Both the tank and the channel are maintained at the filling pressure.

As the liquid fills the container, it eventually immerses the bottom of the return gas tube. The filling material rises in the return gas tube until a state of equilibrium is reached between the level of the filling material surface in the tank and an equilibrium level of the filling material surface in the return gas tube.

The liquid valve is not closed until after this state of equilibrium is reached. In a rotary filling machine, the liquid valve is not closed until the rotor has carried the filling element to a predetermined angular position. The point in time and/or angular position of the rotor at which the liquid valve finally closes are selected so that, when multiple filling elements are present, the desired fill height is reliably reached even with the slowest of these filling elements. This wait occurs even though it is in principle possible to close the liquid valves of the filling elements much earlier. This means that the total duration of the filling process is artificially extended. As a result, the throughput of the filling machine is artificially reduced.

In a known pressure-filling system, each filling element has a probe that governs the fill height in the bottle and that, during filling, extends through the bottle mouth into the bottle or into the bottle's neck or body region. At its lower end the probe forms a probe contact and is at the same time configured as a gas tube with a gas channel that is open above the probe contact by radial openings.

SUMMARY

The invention provides a method for the pressure-filling of bottles or similar containers that, among other things, makes it possible to reduce the total duration of the particular filling process while maintaining high operational reliability.

The inventive method is executed as a pressure-filling method in which an inert gas or $CO_2$ gas that the inflowing filling material displaces out of a container during filling thereof, i.e. during the filling phase, is discharged through a return gas tube extending into the container. At the end of the filling phase, the filling material rises in the return gas tube while the liquid valve is still open. A probe provided or configured in the return gas tube effects, either immediately or with a preselected delay, a closing of the liquid valve as soon as the filling material rising in the return gas tube reaches the probe or the probe's response level. In some embodiments, this response level is equal to the equilibrium level. However the probe's response level is preferably lower than the equilibrium level so that a closing of the liquid valve is effected or initiated before the filling material rising in the return gas tube reaches the equilibrium level.

In one aspect, the invention features a method for pressure-filling containers with a filling material using a single-chamber filling system having a filling element that, in a filling element housing, has a liquid channel having a liquid valve. The liquid channel is connected, in a direction of flow of the filling material upstream of the liquid valve, to a liquid space of a filling material tank that is partly filled with the filling material and that is maintained at a pre-tensioning or filling pressure. In a direction of flow of the filling material downstream of the liquid valve, the filling material tank forms a discharge opening against which a container is arranged with a container opening thereof in sealed position at least during filling thereof. The filling material tank comprises a return gas tube that extends into the container during filling thereof and through which, during filling, inert gas displaced from the container, which is pre-tensioned with an inert gas, is returned into a manifold carrying the inert gas at the pre-tensioning or filling pressure, or a gas space of the filling material tank. After immersion of a lower return gas tube end of the return gas tube into a filling-material surface rising in the container, the filling material rises to a level at which further filling of the container with the filling material is ended. The method includes effecting further filling of the container. Further filling of the container includes providing a probe disposed or configured in a return gas channel. The probe is configured to generate a probe signal as soon as the filling material, which rises in the return gas channel, reaches a response level of the probe. The liquid valve responds to this probe signal by closing.

Some practices of the invention also include having the probe limit the rise of the filling material in the gas channel.

Other practices include selecting the response level of the probe to be above a level of the lower return gas tube end and below a level up to which, in the absence of closing the liquid valve in response to the probe signal, the liquid filling material would rise in the return gas channel before reaching an equilibrium state thereof.

Yet other practices include inserting the probe into the return gas tube or a return gas channel thereof. In these practices, the probe is a rod-shaped probe that has either a probe contact or an electrical measuring circuit for responding to liquid filling material disposed in a region of a lower probe end thereof.

In another practice, in which the container has a headspace that remains unoccupied by the filling material, responding to the probe signal further comprises causing a simultaneous reduction in pressure in the head space down to a pressure that is less than the filling pressure. This helps prevent expansion pulses of the filling material at a surface of the filling material surface in the container after the container, which will have been filled, is removed from the filling element. It also helps prevent filling-material residues in the return gas tube after the container, which will have been filled, is removed from the filling element.

In another practice, in which the container once again has a headspace that remains unoccupied by the filling material, responding to the probe signal further comprises emptying the gas tube by creating a gas connection between the head space and an end of the return gas tube or gas channel facing away from the container. This helps prevent expansion pulses of the filling material into a surface of the filling material surface in the container after the container, which will have been filled, is removed from the filling element. It also helps prevent filling-material residues in the return gas tube after the container, which will have been filled, is removed from the filling element.

Another practice of the invention includes providing a siphon-like gas seal in a region of the liquid valve when the liquid valve is open.

Yet another practice includes regulating an output of either the filling element or that of a filling machine comprising a plurality of filling elements. This regulation is carried out as a function of the probe signal.

In another aspect, the invention features an apparatus comprising a filling element for pressure-filling containers with a filling material. The filling element includes a liquid channel configured in a filling element housing, and a liquid valve in the liquid channel. The liquid channel is connected, in a direction of flow of the filling material upstream of the liquid valve, to a liquid space of a filling material tank that is partly filled with filling material and maintained at a pre-tensioning or filling pressure. The liquid channel forms, in the direction of flow of the filling material, downstream of the liquid valve, a discharge opening against which a container is arranged by a container opening in a sealed position at least while it is being filled. The filling element also has a return gas tube that extends into the container while it is being filled. During filling, inert gas displaced from the container, which is pre-tensioned with an inert gas, passes through this return gas tube for return to either a manifold carrying the insert gas at pre-tensioning or filling pressure or a gas space of the filling material tank. After immersing of a lower return gas tube end of the return gas tube into a filling-material surface rising in the container, the filling material rises to a level at which further filling of the container with the filling material is ended. A probe arranged or configured in the return gas channel generates a probe signal that causes closing of the liquid valve as soon as the filling material, which is rising in the return gas channel, reaches a response level of the probe.

In some embodiments, the probe is a rod-shaped probe inserted into either the return gas tube or a return gas channel thereof. The probe has either a probe contact or an electrical measuring circuit that responds to the liquid filling material in a region of the probe's lower end.

In another embodiment, the apparatus also has a gas seal in a region of the liquid valve when the liquid valve is open.

Other embodiments have a controlled gas path that is configured in the filling element and through which at least a pre-tensioning of a container located in sealed position with the filling element and a return of the inert gas displaced from the container during filling takes place. A one-way restrictor unit brings about an unrestricted inert gas flow for pre-tensioning and a restricted inert gas flow when filling through this path.

For the purpose of the invention the expression "essentially" means variations from the respective exact value by ±10%, preferably by ±5%.

Further embodiments, advantages and possible applications of the invention arise out of the following description of embodiments and out of the figures. All of the described and/or pictorially represented attributes, whether alone or in any desired combination are fundamentally the subject matter of the invention independently of their synopsis in the claims or a retroactive application thereof. The content of the claims is also made an integral part of the description.

BRIEF DESCRIPTION OF THE FIGURES

The invention is explained in detail below through the use of an embodiment example with reference to the figures. In the

FIGURES

Figure 1:
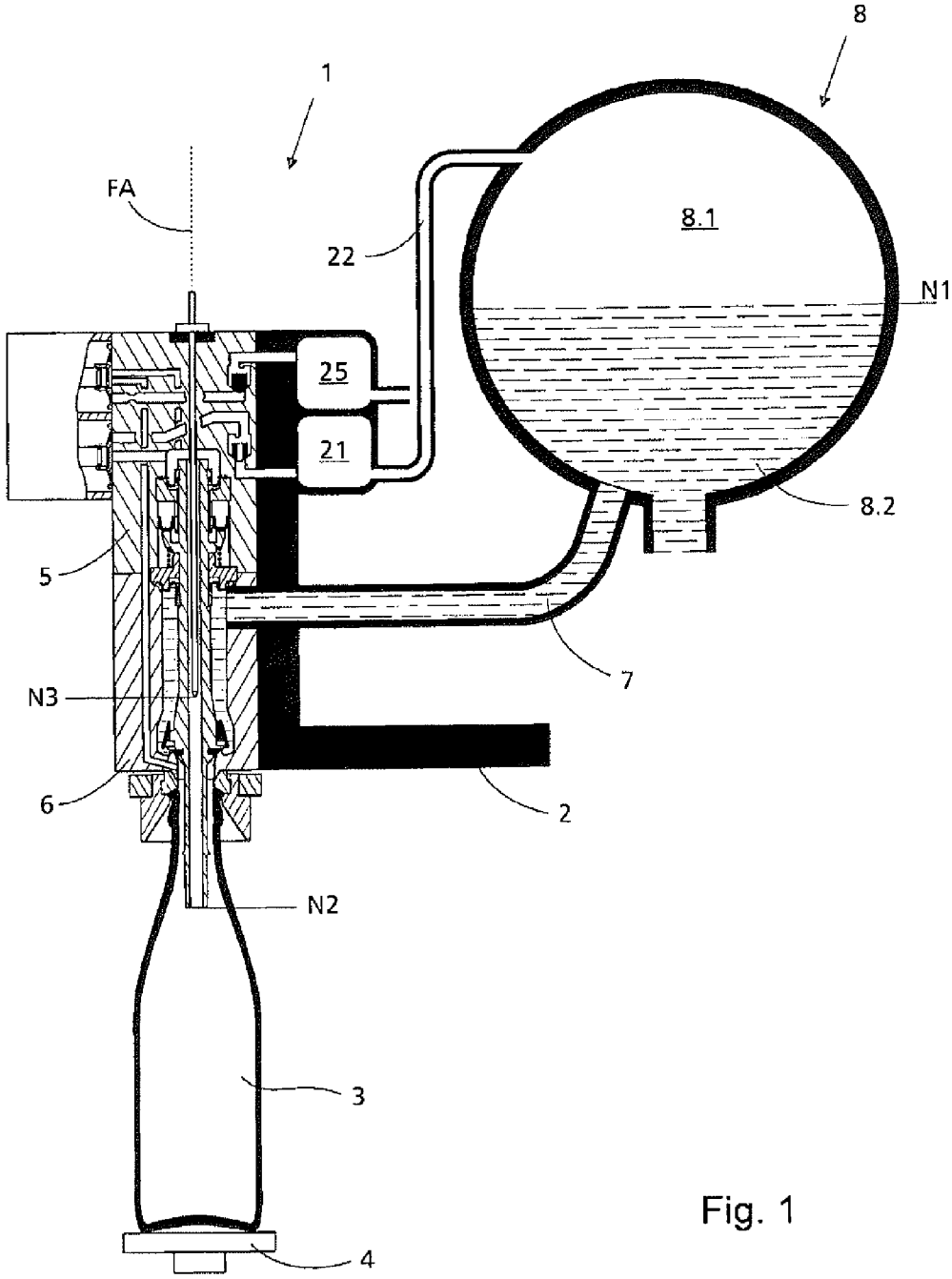
Figure 2:
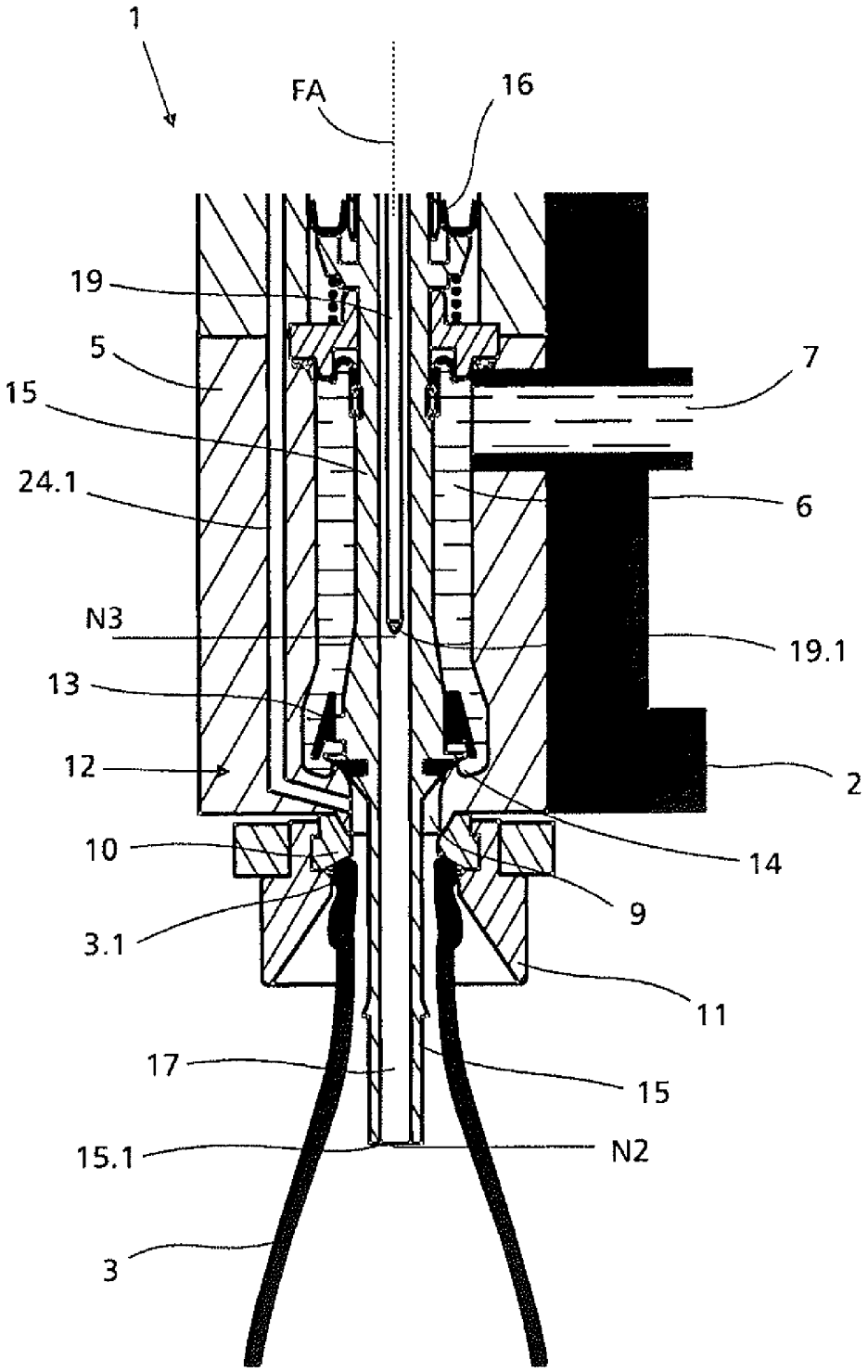
Figure 3:
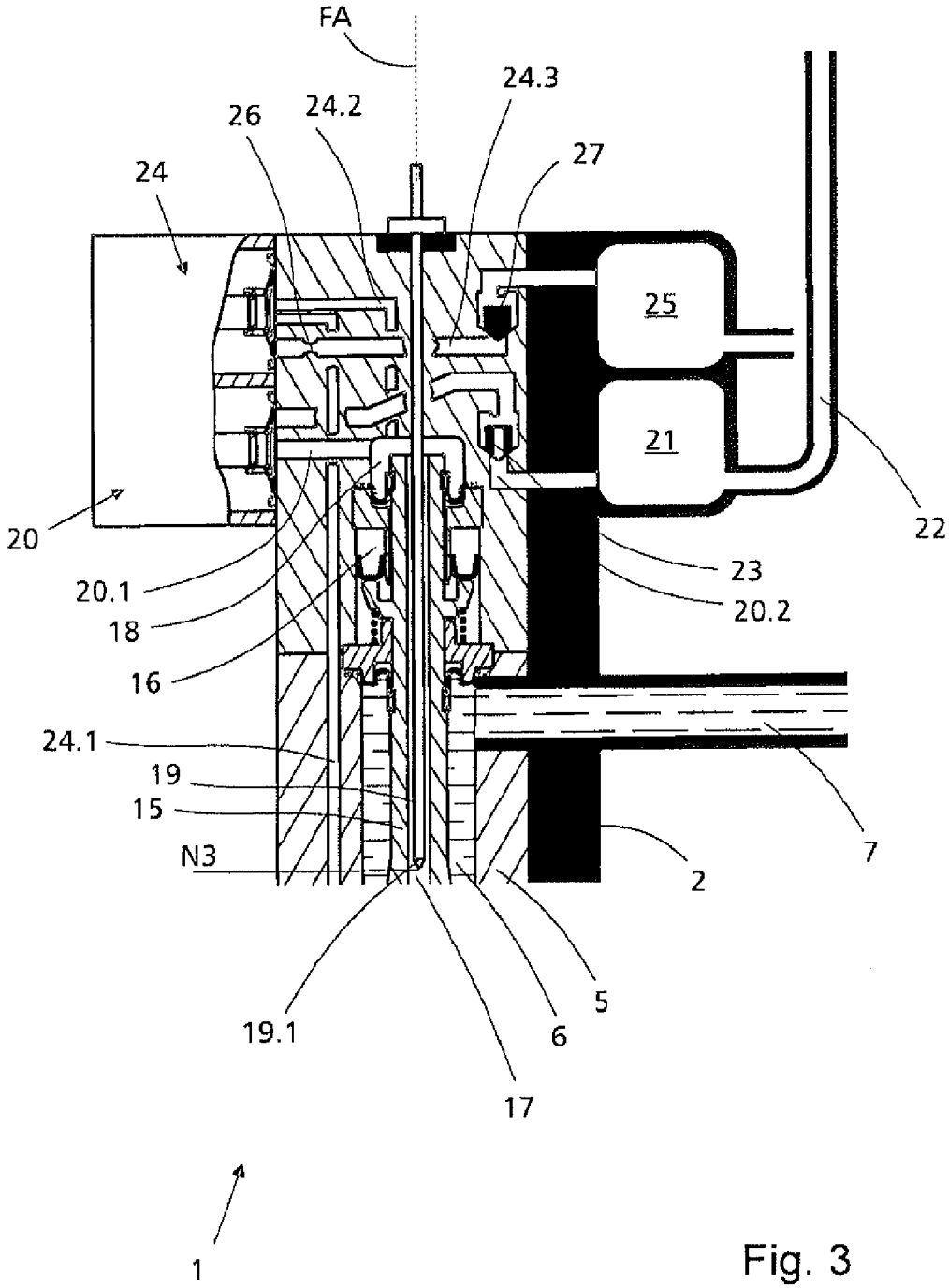

FIG. 1 shows in simplified representation a filling element of a filling system or of a filling machine for the pressure-filling of bottles with a liquid filling material, together with a bottle that is raised or pressed in sealed position against the filling element;

FIGS. 2 and 3 each show details of the filling element in enlarged representation.

DETAILED DESCRIPTION

FIG. 1 shows a filling element 1 of a filling machine having a plurality of identical filling elements of the same type on the periphery of a rotor 2 that can be driven to rotate about a vertical machine axis. The filling element 1 is used for pressure-filling of bottles 3 or other containers with a liquid filling material.

Beneath the filling element is a container carrier 4. In FIG. 1, a bottle stands upright with its bottle base resting on the container carrier 4 and its bottle mouth 3.1 pressed against the filling element 1.

The filling procedure has a pre-tensioning phase and a filling phase. During the pre-tensioning phase, and optionally also during the filling phase, the container carrier 4 presses the bottle mouth 3.1 in a sealed position against the filling element 1, as shown in FIG. 1.

The filling element 1 comprises a filling element housing 5 in which is configured, among other things, a liquid channel 6 having an upper end. A pipe 7 connects the liquid channel 6, via its upper end, to an annular tank 8. All filling elements 1 of the filling machine share the annular tank 8.

During the filling operation, liquid filling material partially fills the annular tank 8 to a tank level N1 in a level-controlled manner. As a result, during the filling operation, the annular tank 8 has a gas space 8.1 disposed above a lower liquid space 8.2. A gas, typically an inert gas such as $CO_2$, occupies the gas space at a filling pressure considerably above the normal or ambient pressure. The liquid space 8.2 connects to all filling elements 1 via respective pipes 7.

In the depicted embodiment, filling elements 1 are provided on the radially outward side of the annular tank 8 relative to the vertical machine axis. This is an optimal position for the filling elements 1 in part because it simplifies maintenance and cleaning.

Referring now to FIG. 2, on the underside of the housing 5, the liquid channel 6 forms an annular discharge opening 9 for discharge of the filling material. Also provided on the underside of the filling-element housing 5 is a ring seal 10 that encloses the discharge opening 9. The ring seal 10 is part of a centering tulip 11 that can be raised and lowered by a short stroke in the direction of a vertical filling-element axis FA for centering a bottle 3. At least during the pre-tensioning phase, and possibly during the filling phase of the filling operation, the bottle 3 is pressed by its bottle mouth 3.1 against the ring seal 10 with its bottle axis disposed on the same axis as the filling-element axis FA.

A valve body 13 interacting with an annular valve seat 14 forms a liquid valve 12 in the liquid channel 6. The liquid valve 12 can be opened and closed in a controlled manner. The annular valve seat 14, which is configured on the inner surface of the liquid channel 6, concentrically encloses the filling-element axis FA.

In the depicted embodiment, a return gas tube 15 that extends along the filling-element axis FA. The valve body 13 is formed by and also acts as a valve stem. An actuating device 16 moves the return gas tube 15 up and down in a controlled manner through a predetermined stroke along the filling-element axis FA. This movement opens and closes the liquid valve 12. The figures depict the liquid valve 12 in its closed state. When the liquid valve 12 is in its open state, the valve body 13 and the inner surface of the liquid channel 6 in the region of valve seat 14 form a siphon-like gas seal.

The return gas tube 15 extends beyond the underside of the filling element 1 and ends at a lower return gas tube end 15.1 at a return-gas-tube level N2 that is beyond the underside of the filling element 1 and below the tank level N1, as shown in FIG. 1. A length of the return gas tube 15 thus protrudes into a bottle 3 located in the sealed position at the filling element 1. The return gas tube 15 forms a return gas channel 17 that is open at the lower return gas tube end 15.1. An upper end of the return gas channel 17 discharges into a gas space 18 formed in filling element housing 5, as shown in FIG. 3.

A probe 19 extends inside the gas tube 15 along the filling element axis FA. The probe 19 responds to the liquid filling material. In particular, when filling material wets a lower probe end 19.1 located at a response level N3, which lies below the tank level N1, the probe 19 delivers or initiates an electrical signal that causes the liquid valve 12 to close. This signal can be caused by, for example, a change in the electrical properties of the probe 19 or of a measuring circuit formed between electrodes of the probe 19.

In the region of the probe 19, the return gas channel 17 becomes a first ring channel between an inner surface of the return gas tube 15 and an outer surface of the probe 19. As the figures also show, the lower probe end 19.1 inside the return gas tube 15 is arranged at a distance above the lower return gas tube end 15.1. As a result, the response level N3 is not only above the return-gas-tube level N2 but also above the liquid valve 12 and the valve seat 14.

Referring now to FIG. 3, within the filling element housing 5 are several controlled gas paths with, in the depicted embodiment, a gas path having a first control valve 20. Opening the first control valve 20 connects the gas space 18 to a second ring channel 21 provided on the rotor 2. This second ring channel 21 is common to all filling elements 1 of the filling machine. A pipe 22 connects the second ring channel 21 to the gas space 8.1 within the tank 8. The second ring channel 21 therefore carries inert gas at the filling pressure.

In the illustrated embodiment, the gas path that includes the first control valve 20 comprises first and second gas channels 20.1, 20.2. The first gas channel 20.1 connects the first control valve 20 to the gas space 18. The second gas channel 20.2 connects the first control valve 20 to the second ring channel 21.

A one-way restrictor 23 interrupts the second gas channel 20.2. In one embodiment, the one-way restrictor 23 includes a combination of a throttle valve and a check valve. The one-way restrictor 23 is constructed so that opening the first control valve 20 causes an un-throttled gas flow out of the second ring channel 21, through the first and second gas channels 20.2, 20.1, and into the gas space 18. For this direction of flow, the throttle of the one-way restrictor 23 is inactive. However, for gas flow in the opposite direction, the throttle of the one-way restrictor 23 is fully active.

In the embodiment shown in FIG. 3, two further controllable gas paths are provided in the filling element housing 5. The two further controllable gas paths have a common second control valve 24.

When open, the second control valve 24 connects the liquid channel 6 in the region of the discharge opening 9 and in the flow direction of the liquid filling material to the liquid valve 12 with the gas space 18 and also, in a throttled manner, to a third ring channel 25. This third ring channel 25 is provided on the rotor 2 for all filling elements 1 of the filling machine. The third ring channel 25 is thus common to all filling elements.

In operation, the third ring channel 25 serves as a return gas ring channel that carries return gas at normal or ambient pressure or at a pressure slightly above normal and ambient pressure. In some embodiments, the excess pressure is in the range from 0 to 1.5 bar above normal or ambient pressure.

The second control valve 24 forms a controllable gas path having gas channels configured in the filling element housing 5. These include a first gas channel 24.1, a second gas channel 24.2, and a third gas channel 24.3.

The first gas channel 24.1 connects the liquid channel 6 in the region of discharge opening 9 to the second control valve 24. The second gas channel 24.2 connects the second control valve 24 to the gas space 8. The third gas channel 24.3 connects the second control valve 24 to the third ring channel 25.

The third gas channel 24.3 includes a throttle 26 and a check valve 27 disposed therein. The check valve 27 opens for a gas flow from the third gas channel 24.3 into the third ring channel 25 and closes for a gas flow in the opposite direction. The check valve 27 thus prevents a return flow of return gas from the third ring channel 25 into the first, second, and third gas channels 24.1-24.3 when the second control valve 24 is open. The first and second control valves 20, 24 are depicted in their closed, non-activated state.

In the illustrated embodiment, the actuating device 16, the first control valve 20, and the second control valve 24 are pneumatically controlled by electrical control valves (not shown) of an electronic control device (also not shown) of the filling machine. The probe 19 feeds its signal to the control device.

The filling element 1 pressure-fills bottles 3 with the liquid filling material from annular tank 8 in the following manner:

A bottle 3 that is to be filled stands upright with its base on the container carrier 4 and with its bottle axis aligned in the direction of the filling element axis FA. The container carrier 4 raises this bottle 3 so that it lies with its bottle mouth 3.1 against the ring seal. An annular gap to the surroundings is left in the region of the bottle mouth 3.1. The return gas tube 15 extends by its lower return gas tube end 15.1 into the bottle 3.

In this state, a first process step of the filling process takes place. During this first step, which marks the purging phase, the interior of bottle 3 is purged with $CO_2$ gas to remove the air present in the bottle as completely as possible. This step includes closing the liquid valve 12 and opening the first control valve 20. As a result, $CO_2$ gas from the second ring channel 21 is introduced or blown across the gas space 18, and the return gas channel 17 into the interior of bottle 3. The incoming gas displaces the air originally present in bottle 3 out of the bottle interior through the annular gap.

A second process step marks a pre-tensioning phase of the filing process. During the pre-tensioning phase, the bottle 3 is raised into the sealed position against the filling element 1 so that the ring seal 10 establishes a tight connection between the discharge opening 9 and the interior of the bottle 3. The actual pre-tensioning occurs when the first control valve 20 is opened while the liquid valve 12 is still closed. This enables $CO_2$ gas under pressure to flow through the open first control valve 20, the gas space 18, and the gas channel 17 into the interior of the bottle 3. As a result, the bottle interior is pre-tensioned to the pre-tensioning and filling pressure.

In both the purging phase and pre-tensioning phase, the throttle of the one-way restrictor 23 is not effective. As a result, an unrestricted gas flow out of the second ring channel 21 into the bottle 3 becomes possible. This tends to reduce cycle times for the purging phase and the pre-tensioning phase, thus increasing the number of filled bottles 3 per unit of time that the filling machine can output.

During the subsequent filling phase, which is initiated by opening the liquid valve 12, the bottle 3 is still in the sealed position against the filling element 1. At least a rapid filling of bottle 3 occurs during the filling phase while the first control valve 20 is also open. As a result, the $CO_2$ gas that is displaced from the bottle interior by the filling material flowing into the bottle 3 through the discharge opening 9 can flow back into the second ring channel 21 through the return gas channel 17, the gas space 18 and the open first control valve 20.

The speed at which the liquid filling material flows into bottle 3 is determined by, among others things, the tank level Ni. To achieve a defined filling speed, during the filling phase the gas path for the $CO_2$ gas displaced from bottle 3 into the second ring channel 21 is restricted by the throttle of the one-way restrictor 23, which is effective in this direction of flow. The one-way restrictor 23 therefore automatically adapts to the different requirements associated with purging and pre-tensioning on the one hand, and pressure filling on the other. It does so without the need for an additional control valve and without the need for any reconstruction.

When the filling material surface 3 reaches the return-gas-tube level N2, the lower return gas tube end 15.1 is immersed in the filling material. As a result, any $CO_2$ gas left in the head region of bottle 3, i.e. in the region between the filling material surface in the bottle 3 and the open liquid valve 12 and/or the gas seal there formed, can no longer flow into the return gas channel 17. Instead, the liquid filling material in this return gas channel 17 will rise.

If the probe 19 were not present, the filling material surface in the return gas channel 17 would reach an equilibrium level. Because of the gas seal of the open liquid valve and the $CO_2$ gas trapped in the headspace of bottle 3, this equilibrium level lies below the tank level N1 but above the response level N3 of the probe 19. However, with the probe 19 being present, a probe-controlled closing of liquid valve 12 is initiated when the filling material rising in the return gas channel 17 has already reached response level N3. Thus, in contrast to prior art filling machines for pressure filling of containers, the liquid valve 12 does not have to wait to close until a predetermined period of time has elapsed or until a predetermined angular position of rotor 2 of the filling machine has been reached.

Preferably, the probe signal that triggers closing of the liquid valve 12 also causes the closing of the first control valve 20 and the opening of the second control valve 24. Since the bottle 3 would still be sealed against the filling element 1, the opened second control valve 24 relieves pressure in the headspace of bottle 3 into the third ring channel 25. As a result of a connection provided by the first and second gas channels 24.1, 24.2 between the gas space 18 and the region of the discharge opening 9 over the first and second gas channels 24.1, 24.2, the opened second control valve 24 also empties the return gas channel 17 or return flow of the filling material out of the return gas channel 17 into the bottle 3. Meanwhile, the check valve 27 prevents return flow of return gas from the third ring channel 25 into the headspace of bottle 3.

The filling process ends when the container carrier 4 lowers the filled bottle 3 until the return gas tube 15 is completely withdrawn from the bottle 3. The filled bottle 3 is then removed from the container carrier 4 and passed to another machine for further processing. An example of further processing is sealing.

During the operation of the filling machine, and in particular, during the purging operation, $CO_2$ gas is continuously withdrawn from the second ring channel 21. This gas is replenished through the pipe 22 from the gas space 8.1 of the annular tank 8. As a result, although $CO_2$ gas is being returned to the second ring channel 21 during the filling phase, no $CO_2$ gas and in particular no $CO_2$ gas contaminated with air, passes from the second ring channel 21 into the gas space 8.1 of the tank 8. Pure $CO_2$ gas is therefore always present inside the tank 8 at the phase boundary with the filling material.

The described filling element 1 has considerable advantages:

The filling element 1 enables accelerated purging and pre-tensioning of the bottle 3 with an unrestricted $CO_2$ gas flow independently of the probe 19. At the same time, during the filling phase, the one-way restrictor 23 provided in the first gas channel 20.1 provides a restricted return gas flow, which results in an optimum and repeatable filling speed.

In addition, the probe 19 limits the rise of filling material in the return gas tube 15. It does so by causing the liquid valve 12 to close before the normal state of equilibrium has occurred or before the level of the liquid filling material in the return gas channel 17 has risen to the level corresponding to this equilibrium state.

The filling machine described herein thus creates the possibility of reducing the total duration of the filling process, or equivalently, increasing the number of filled bottles 3 per unit time that can be output by the filling machine. It does so by, for example, having a central control unit or central processor of the filling machine that measures the time to the response of the probe 19 separately for all filling elements 1 and then controlling the speed of the filling machine so that, even at the slowest filling element 1 of the filling machine, the filling process is reliably completed before the container carrier 4 lowers the bottle 3.

The amount of filling material rising in the return gas channel 17, and hence the amount of filling material returned to a bottle 3, can also be kept small by appropriate selection of the response level N3, i.e. by appropriately approximating the response level N3 relative to the return-gas-tube level N2.

The closing of the liquid valve 12 after the probe 19 has responded also avoids having filling material continue to flow from the liquid channel 6 into the bottle 3 as a result of vibrations of the filling machine. Such vibrations are common in known probe-less filling machines for pressure-filling of containers or bottles.

Through the triggering of the first control valve 20 and the second control valve 24, and in particular the opening of the second control valve 24 on the basis of a signal from the probe 19, after the closing of the liquid valve 12 there is effected an early pressure relief both of the head space of the bottle 3 and of the return gas channel 17 across the throttle 26, as well as an emptying of the return gas channel 17. This early pressure relief avoids the occurrence of an abrupt emptying, or expansion pulse, of the return gas channel 17 into the filling material surface of a filled bottle 3 and an associated froth over of the filling material in the bottle 3 when the bottle 3 is pulled off or lowered down from filling element 1.

The early emptying of the return gas tube 15 also avoids having filling material residues remain in the gas tube 15 during or after the lowering of the bottle 3 from the filling element 1. This contributes to reducing the total duration of the filling process and hence to increasing the output of the filling machine, particularly when the filling material is carbonated, and therefore prone to frothing.

Using the probe 19 also makes it possible to dispense with the gas seal in the region of liquid valve 12.

A further advantage is that, as a result of the probe's response and the closing of the liquid valve 12, the connection between the annular tank 9 and the bottle 3 is immediately interrupted upon reaching the desired fill height. As a result, it is possible to avoid fill height fluctuations in bottles 3, including, in particular, those caused by pressure variations in the gas space 8.1 and those caused by variations in the tank level N1.

Because the head space of a bottle 3 is also connected via the second control valve 24 to the gas space 18 or to the upper end of the return gas tube 17 after the liquid valve 12 closes, it is also possible to pull the filled bottle 3 from the filling element 1 while there is still some slight positive pressure in the bottle without there being an abrupt discharge of filling material present in the return gas tube 17 or frothing in the bottle 3. The ability to do so likewise contributes to a reduction in the overall duration of the filling process and an increase in the output of the filling machine.

The advantages described above arise even though the filling element 1 does not require any fundamental structural alterations. As a result, it is possible to use a proven filling-element design that has already been tried and tested with filling machines and single-chamber filling machines for the pressure-filling of containers.

The invention has been described by reference to one embodiment. It goes without saying that numerous variations as well as modifications are possible without departing from the inventive concept underlying the invention.

For example, in an alternative embodiment, the liquid valve 12 achieves a fill-height correction by closing following a certain time delay after the probe 19 responds.

Having described the invention, and a preferred embodiment thereof, what is claimed as new, and secured by Letters Patent is:

1. A method for pressure-filling containers with a filling material using a single-chamber filling system having a filling element that, in a filling element housing, exhibits a liquid channel having a liquid valve, said liquid channel being connected, in a direction of flow of said filling material upstream of said liquid valve, to a liquid space of a filling material tank that is partly filled with said filling material and that is maintained at a pre-tensioning or filling pressure, and wherein, in a direction of flow of said filling material downstream of said liquid valve, said filling material tank forms a discharge opening against which a container is arranged with a container opening thereof in sealed position, at least during filling thereof, and wherein said filling material tank comprises a return gas tube that extends into said container during filling thereof and through which, during filling, inert gas displaced from said container, which is pre-tensioned with an inert gas, is returned into one of a manifold carrying said inert gas at said pre-tensioning or filling pressure, and a gas space of said filling material tank, and in which, after immersion of a lower return gas tube end of said return gas tube into a filling-material surface rising in said container, said filling material rises to a level at which further filling of said container with the filling material is ended, said method comprising effecting further filling of said container, wherein effecting further filling of said container comprises providing a probe disposed or configured in a return gas channel, said probe being configured to generate a probe signal as soon as said filling material, which rises in said return gas channel, reaches a response level of said probe, and responding to said probe signal by closing said liquid valve.

2. The method of claim 1, further comprising limiting, by said probe, rise of said filling material in said gas channel.

3. The method of claim 1, further comprising selecting said response level of said probe to be above a level of said lower return gas tube end and below a level up to which, in the absence of closing said liquid valve in response to said probe signal, said liquid filling material would rise in said return gas channel before reaching an equilibrium state thereof.

4. The method of claim 1, further comprising inserting said probe into said return gas tube or a return gas channel thereof, said probe being a rod-shaped probe comprising one of at least one probe contact and at least one electrical measuring circuit for responding to liquid filling material disposed in a region of a lower probe end thereof.

5. The method of claim 1, wherein after filling, said container has a head space that remains unoccupied by said filling material, and wherein responding to said probe signal further comprises causing a simultaneous reduction in pressure in said head space down to a pressure less than said filling pressure to prevent at least one of expansion pulses of said filling material into a surface of said filling material surface in said container and filling-material residues in said return gas tube after said container, which has been filled, is removed from said filling element.

6. The method of claim 1, wherein after filling, said container has a head space that remains unoccupied by said filling material, and wherein responding to said probe signal further comprises emptying said gas tube by creating a gas connection between said head space and an end of said return gas tube or gas channel facing away from said container to prevent at least one of expansion pulses of said filling material into a surface of said filling material surface in said container, and filling-material residues in said return gas tube after said container, which has been filled, is removed from said filling element.

7. The method of claim 1, further comprising providing a gas seal in a region of said liquid valve when said liquid valve is open, wherein said gas seal comprises a siphon.

8. The method of claim 1, further comprising regulating an output of one of said filling element and a filling machine comprising a plurality of filling elements as a function of said probe signal.

9. An apparatus comprising a filling element for pressure-filling containers with a filling material, said filling element comprising at least one liquid channel configured in a filling element housing, at least one liquid valve in said at least one liquid channel, said at least one liquid channel being connected, in a direction of flow of said filling material upstream of said at least one liquid valve, to a liquid space of a filling material tank that is partly filled with filling material and maintained at a pre-tensioning or filling pressure, said at least one liquid channel forming, in said direction of flow of said filling material, downstream of said at least one liquid valve, at least one discharge opening against which a container is arranged by a container opening in a sealed position at least during filling thereof, and having a return gas tube extending into said container during filling thereof through which, during filling, inert gas displaced from said container, which is pre-tensioned with an inert gas, is returned into one of a manifold carrying said insert gas at pre-tensioning or filling pressure and a gas space of said filling material tank, and in which, after immersing of a lower return gas tube end of said return gas tube into a filling-material surface rising in said container, said filling material rises to a level at which further filling of said container with said filling material is ended, and a probe arranged or configured in said return gas channel, said probe being configured to generate a probe signal to cause closing of said liquid valve as soon as said filling material, which is rising in said return gas channel, reaches a response level of said probe.

10. The apparatus of claim 9, wherein said probe is a rod-shaped probe inserted into one of said return gas tube and a return gas channel thereof, said probe comprising one of at least one probe contact and at least one electrical measuring circuit, said one of at least one probe contact and at least one electrical measuring circuit being configured to respond to said liquid filling material in a region of a lower probe end.

11. The apparatus of claim 9, further comprising a gas seal provided or configured at least in a region of said liquid valve when said liquid valve is open.

12. The apparatus of claim 9, further comprising, in a controlled gas path that is configured in said filling element, and through which at least a pre-tensioning of a container located in sealed position with said filling element and a return of the inert gas displaced from the container during filling takes place, a one-way restrictor unit that through said controlled gas path, brings about an unrestricted inert gas flow for pre-tensioning and a restricted inert gas flow when filling.

* * * * *